US012264549B2

(12) United States Patent
Dikshit et al.

(10) Patent No.: US 12,264,549 B2
(45) Date of Patent: Apr. 1, 2025

(54) SYSTEM AND METHODOLOGY TO COMBINE SAND CONTROL AND ZONAL ISOLATION FOR ARTIFICIAL LIFT SYSTEMS

(71) Applicant: Schlumberger Technology Corporation, Sugar Land, TX (US)

(72) Inventors: Ashutosh Dikshit, Houston, TX (US); Abhinandan Tripathi, Midland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 182 days.

(21) Appl. No.: 17/664,519

(22) Filed: May 23, 2022

(65) Prior Publication Data

US 2022/0389788 A1 Dec. 8, 2022

Related U.S. Application Data

(60) Provisional application No. 63/196,800, filed on Jun. 4, 2021.

(51) Int. Cl.

| | |
|---|---|
| ***E21B 33/124*** | (2006.01) |
| ***E21B 43/08*** | (2006.01) |
| ***E21B 43/10*** | (2006.01) |
| ***E21B 43/12*** | (2006.01) |

(52) U.S. Cl.

CPC ..... *E21B 33/1243* (2013.01); *E21B 43/086* (2013.01); *E21B 43/103* (2013.01); *E21B 43/128* (2013.01)

(58) Field of Classification Search

CPC .. E21B 33/1243; E21B 43/128; E21B 43/086; E21B 43/103; E21B 33/126; E21B 33/124

See application file for complete search history.

(56) References Cited

U.S. PATENT DOCUMENTS

| | | | | |
|---|---|---|---|---|
| 7,243,715 | B2 | 7/2007 | Wang et al. | |
| 2011/0308820 | A1* | 12/2011 | Greenlee | E21B 33/1295 166/387 |
| 2017/0002625 | A1* | 1/2017 | Chochua | E21B 43/12 |
| 2021/0189805 | A1* | 6/2021 | Beck | F04B 47/06 |

* cited by examiner

*Primary Examiner* — Yong-Suk (Philip) Ro
(74) *Attorney, Agent, or Firm* — Michael Wills, III

(57) ABSTRACT

A tubular joint installable on a tubular string disposable within a wellbore. The tubular joint may include includes a perforated section, a filter section, and a packer. The perforated section may be proximate a first end and may include a first plurality of orifices to allow fluid communication between a bore of the tubular joint and a first area surrounding the tubular joint proximate the perforated section. The filter section may be proximate a second end and may include a filter assembly sized to filter fluid flowing into the bore via a second plurality of orifices from a second area proximate the filter section. The packer may be disposed between the perforated section and the filter section and may be operable to isolate the first area from the second area when the tubular string is disposed within the well.

20 Claims, 4 Drawing Sheets

SYSTEM AND METHODOLOGY TO COMBINE SAND CONTROL AND ZONAL ISOLATION FOR ARTIFICIAL LIFT SYSTEMS

CROSS-REFERENCE TO RELATED APPLICATION

This application claims priority to and the benefit of U.S. Provisional Application No. 63/196,800, filed Jun. 4, 2021, which is incorporated by reference herein in its entirety for all purposes.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of casing and other well completions may be deployed downhole. Sometimes, completion systems employ or work in cooperation with an electric submersible pumping system which may be used to pump oil or other hydrocarbon fluids to a collection location.

In producing hydrocarbons or the like from certain subterranean formations, it is common to produce large volumes of particulate material (e.g., sand) along with the formation fluids, especially when the formation has been fractured to improve flow therefrom. This sand production must be controlled, otherwise it may impact the economic life of the well.

SUMMARY

A tubular joint installable on a tubular string disposable within a wellbore according to one or more embodiments of the present disclosure includes a perforated section, a filter section, and a packer. The perforated section is proximate a first end and includes a first plurality of orifices to allow fluid communication between a bore of the tubular joint and a first area surrounding the tubular joint proximate the perforated section. The filter section is proximate a second end and includes a filter assembly sized to filter fluid flowing into the bore via a second plurality of orifices from a second area proximate the filter section. The packer is disposed between the perforated section and the filter section and operable to isolate the first area from the second area when the tubular string is disposed within the well.

A production system disposable within a wellbore according to one or more embodiments of the present disclosure includes a tubular string disposable within the wellbore and a tubular joint coupled to the tubular string. The tubular joint includes a perforated section, a filter section, and a packer. The perforated section is proximate a first end and includes a first plurality of orifices to allow fluid communication between a bore of the tubular joint and a first area surrounding the tubular joint proximate the perforated section. The filter section is proximate a second end and includes a filter assembly sized to filter fluid flowing into the bore via a second plurality of orifices from a second area proximate the filter section. The packer is disposed between the perforated section and the filter section and operable to isolate the first area from the second area when the tubular string is disposed within the well.

A method for producing formation fluids from a formation according to one or more embodiments of the present disclosure includes positioning a tubular string comprising a tubular joint within a wellbore extending through the formation. The method also includes filtering a fluid flowing from a first annulus surrounding a filter section of the tubular joint into the tubular joint via a filter assembly of the tubular joint. The method further includes isolating the first annulus surrounding a second annulus surrounding a perforated section of the tubular joint via a packer of the tubular joint. The method also includes flowing the filtered fluid entering the tubular joint into the second annulus via orifices in the filter section of the tubular joint.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
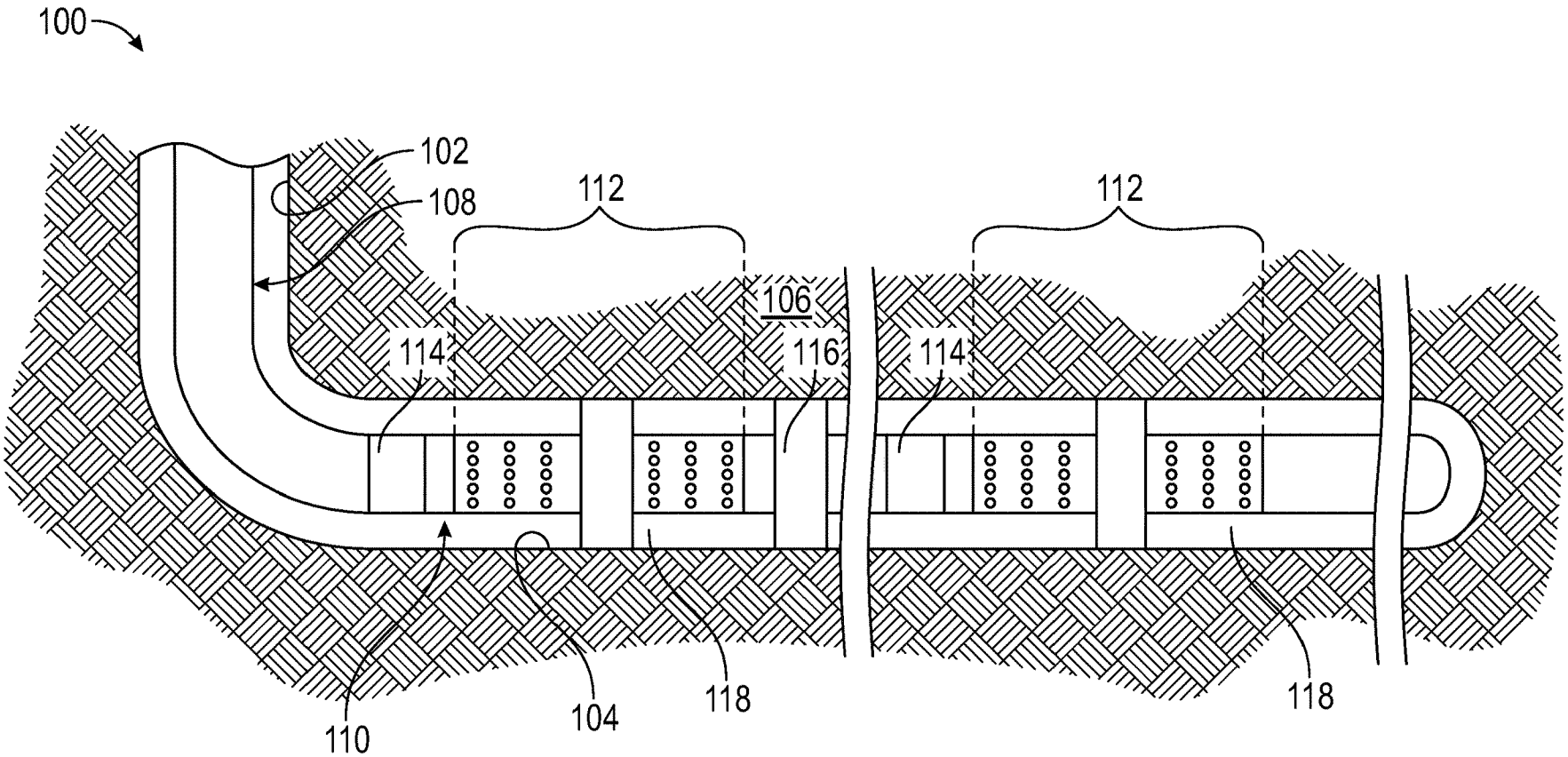
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubular string 108 is deployed downhole into wellbore 102 and comprises a downhole well completion 110 deployed in the deviated, e.g. horizontal, wellbore section 104.

The downhole well completion 110 may be constructed to facilitate production of well fluids and/or injection of fluids. By way of example, the downhole well completion 110 may comprise at least one tubular joint 112, e.g. a plurality of tubular joints 112. Each tubular joint 112 may include a shroud that cover a screen filter, as described in more detail below, through which fluid may enter the corresponding tubular joint 112. The fluid may then be pumped uphole via electric submersible pumps ("ESPs") for production to a suitable location, e.g. a surface location. For example, hydrocarbon well fluids may flow from formation 106, into wellbore 102, and into the tubular joints 112. The hydrocarbon well fluids may then flow from the tubular joints 112 to the ESPs 114. In some embodiments, the downhole well completion 110 also may include one or more packers 116, which may be used to isolate sections or zones 118 along the wellbore 102.

Figure 2:
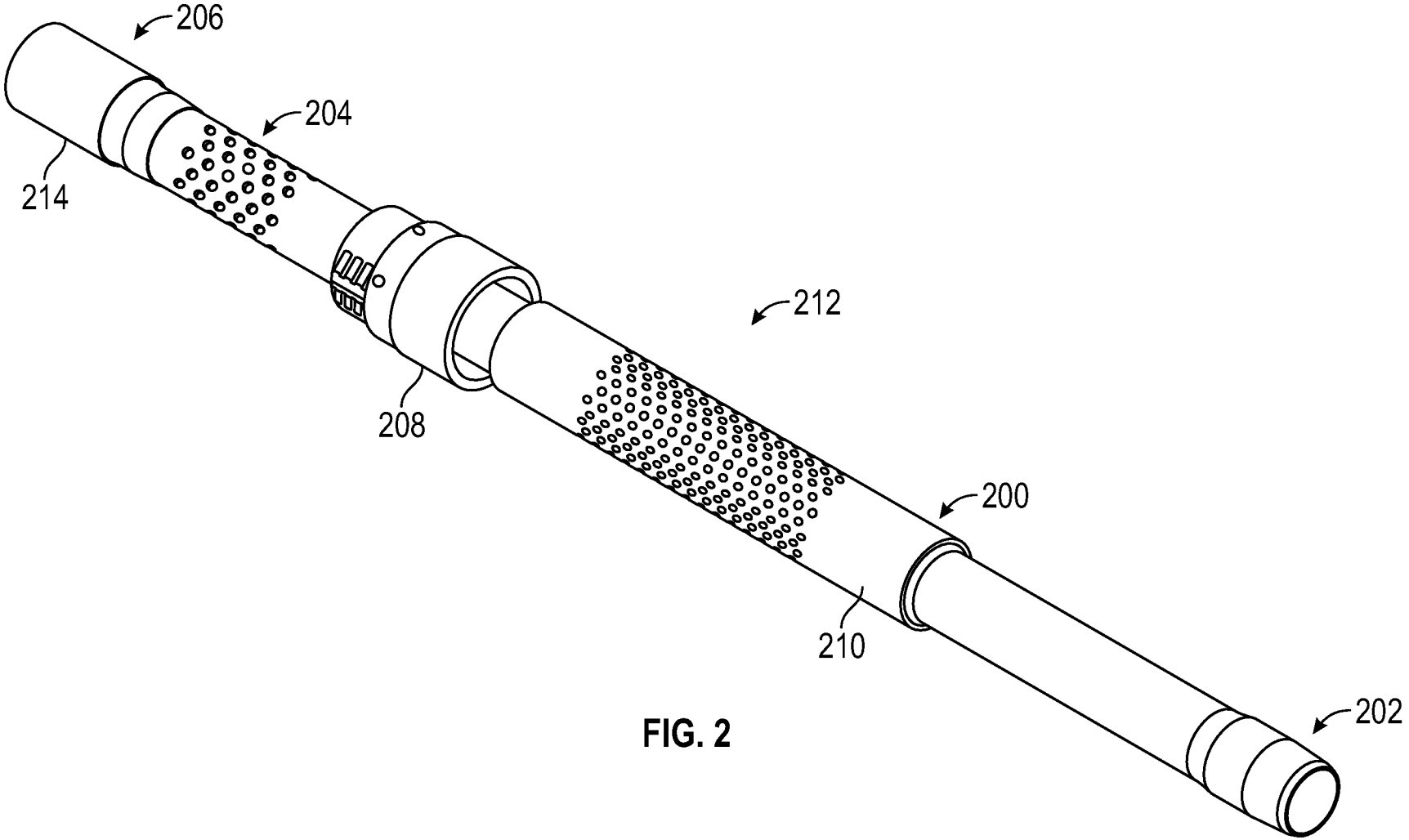
FIG. 2 is an isometric view of a tubular joint according to one or more embodiments of the present disclosure.

Turning now to FIG. 2, FIG. 2 is an isometric view of a tubular joint 212 according to one or more embodiments of the present disclosure. As described above, multiple tubular joints 212 may be coupled to a tubular string, such as the tubular string 108 described above. The tubular joint 212 includes a filter section 200 proximate a lower end 202, a perforated section 204 proximate an upper end 206, and a packer 208 disposed between the filter section 200 and the perforated section 204. According to one or more embodiments of the present disclosure, the filter section 200 includes a sand screen covered by a shroud 210 having a plurality of orifices. In one or more embodiments of the present disclosure, the sand screen of the filter section 200 may be a metallic sand screen, such as a MeshRite screen as described in U.S. Pat. No. 7,243,715, for example, which is incorporated by reference herein in its entirety.

The packer 208 of the tubular joint 212 may be a cup seal packer, for example, according to one or more embodiments of the present disclosure. With this configuration, the packer 208 isolates a producing zone adjacent the filter section 200 so that flow is forced through the filter section 200 for enhanced sand control. That is, in operation, the flow comes from the reservoir, flows into the filter section 200, and flows into the bore of the tubular joint 212.

As shown in FIG. 2, the perforated section 204 of the tubular joint 212 a plurality of orifices. With this configuration, the perforated section 204 is a means to convey fluid to an associated ESP located uphole of the tubular joint 212. Specifically, the orifices provide a path for the flow to exit the bore of the tubular joint 212 into an area surrounding the perforated section 204. The ESP then pumps the flow from the area surrounding the perforated section 204 uphole.

Figure 3:
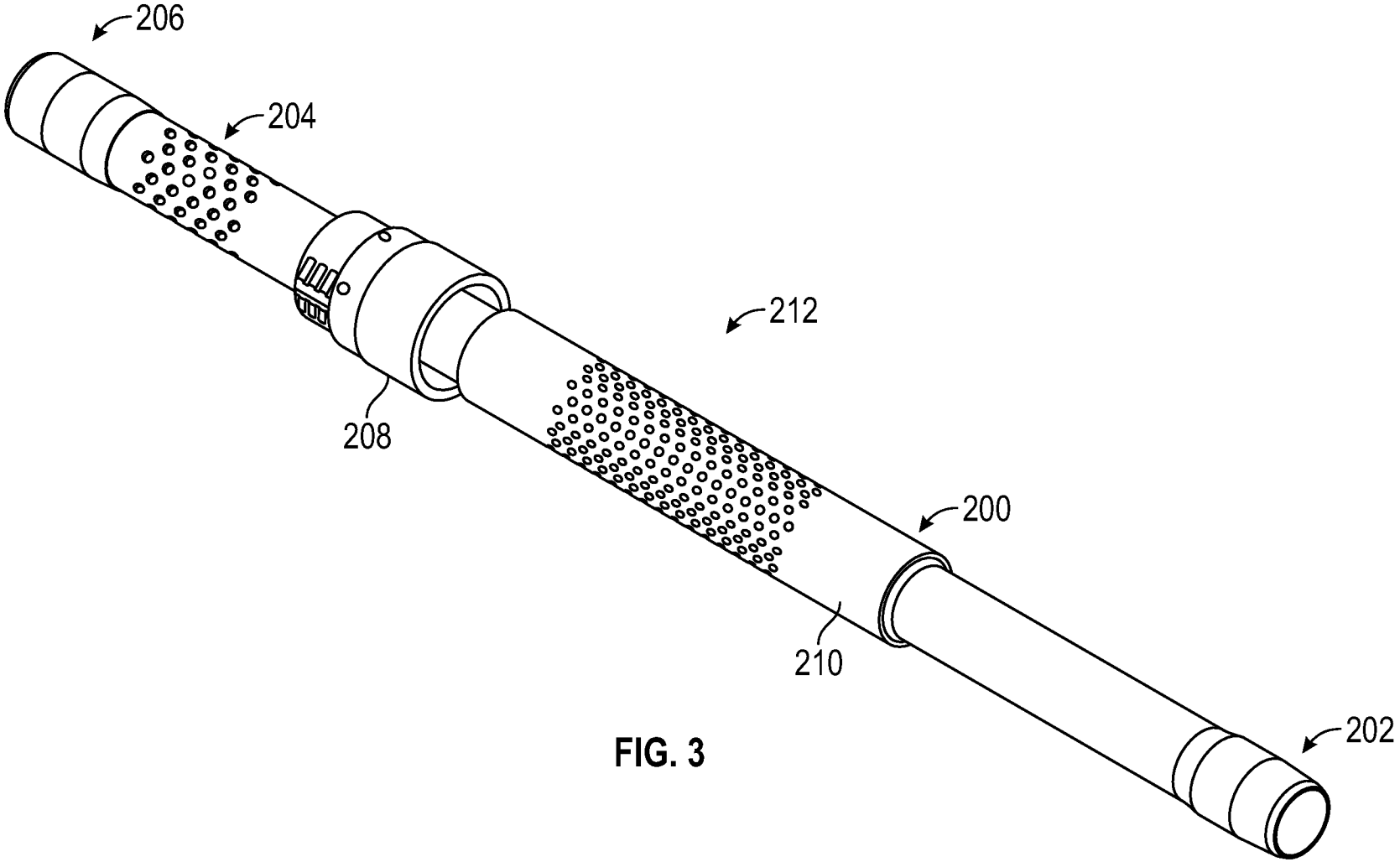
FIG. 3 is an isometric view of a tubular joint according to one or more embodiments of the present disclosure.

As further shown in FIG. 2, the upper end 206 and the lower end 202 of the tubular joint 212 may include a type of threading, such as external upset end (EUE) pins, for example. An EUE coupling 214 may be coupled to the EUE pin at the upper end 206 of the tubular joint 212, according to one or more embodiments of the present disclosure. The EUE coupling 214 may facilitate direct or indirect coupling with the associated ESP located uphole of the tubular joint 212, for example. However, the EUE coupling 214 may be omitted from the tubular joint 212, as shown in FIG. 3, without departing from the scope of the present disclosure.

In either case, any threading of the tubular joint 212 is located at the upper and lower ends 206, 202 of the tubular joint 212, instead of in between one or more of the perforated section 204, the packer 208, and the filter section 200, for example. Therefore, the tubular joint 212 eliminates the need to make up the sand screen joint to the packer joint and then to the perforated pup joint, for example. Moreover, by eliminating separate joints (i.e., multiple tubing/mandrels that have to be screwed together), the tubular joint 212 eliminates undesirable leak paths at threaded connections between one or more of the perforated section 204, the packer 208, and the filter section 200, and reduces the costs and time that would otherwise between required to assemble these sections together.

Figure 4:
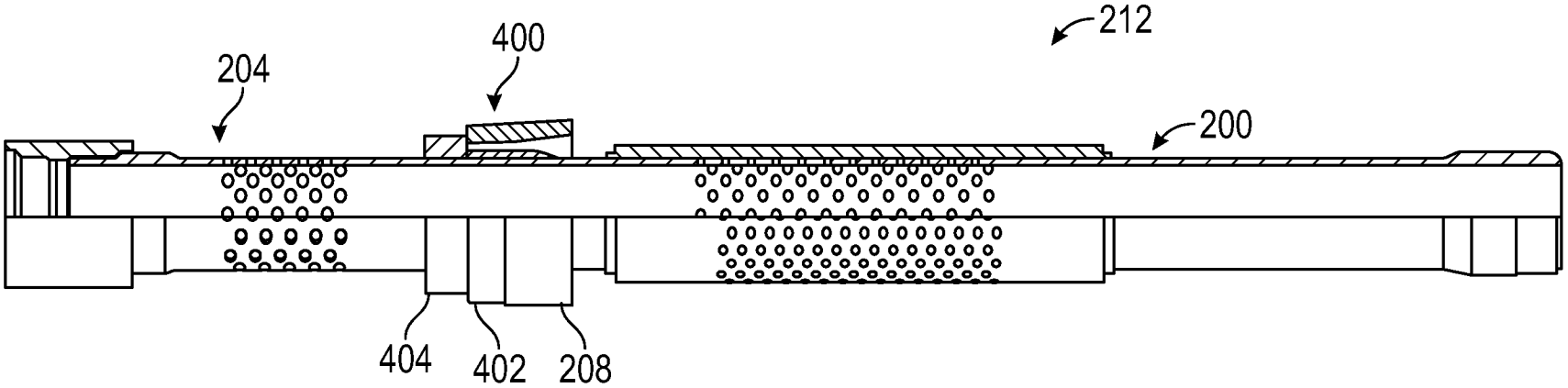
FIG. 4 is a partial cross-sectional view of the tubular joint of FIG. 2.

Turning now to FIG. 4, FIG. 4 is a partial cross-sectional view of the tubular joint 212 of FIG. 2. As shown in FIG. 4, the tubular joint 212 does not include any threaded connections, separate joints, or mandrels with respect to the perforated section 204, the packer 208, and the filter section 200. The packer 208 may be installed or slipped on at the wellsite according to one or more embodiments of the present disclosure. Further, a retention assembly 400 may be installed on the tubular joint 212 during manufacturing according to one or more embodiments of the present disclosure. As shown in FIG. 3, the retention assembly may include a mounting bracket 402 and a retaining ring 404 that are configured to hold the packer 208 in place on the tubular joint 212. According to one or more embodiments of the present disclosure, the mounting bracket 402 and/or retaining ring 404 may be formed in a single piece, split, welded to the tubular joint 212, or non-welded to the tubular joint 212 or to itself. In other embodiments, the retention assembly may include other mechanisms that hold the packer 208 in place on the tubular joint 212.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tubular joint installable on a tubular string disposable within a wellbore, the tubular joint comprising:

a perforated section proximate a first end and comprising a first plurality of orifices to allow fluid to exit a bore of the tubular joint and flow to a first area surrounding the tubular joint proximate the perforated section;

a filter section proximate a second end and comprising a filter assembly sized to filter fluid flowing into the bore via a second plurality of orifices from a second area proximate the filter section; and a packer disposed between the perforated section and the filter section, the packer operable to isolate the first area from the second area when the tubular string is disposed within the wellbore, wherein the perforated section and the filter section are integral on the tubular joint.

2. The tubular joint of claim 1, wherein the filter assembly comprises a sand screen.

3. The tubular joint of claim 2, wherein the sand screen comprises a metallic material.

4. The tubular joint of claim 2, wherein the filter assembly further comprises a shroud surrounding the sand screen.

5. The tubular joint of claim 1, wherein the packer is a cup seal packer.

6. The tubular joint of claim 1, further comprising a retention assembly coupled to the tubular joint to retain the packer on the tubular joint.

7. The tubular joint of claim 6, wherein the retention assembly comprises at least one of a bracket or a retention ring.

8. The tubular joint of claim 1, wherein the packer is a slip-on packer.

9. A production system disposable within a wellbore, the production system comprising:

a tubular string disposable within the wellbore; and a tubular joint coupled to the tubular string and comprising:

a perforated section proximate a first end and comprising a first plurality of orifices to allow fluid to exit a bore of the tubular joint and flow to a first area surrounding the tubular joint proximate the perforated section;

a filter section proximate a second end and comprising a filter assembly sized to filter fluid flowing into the bore via a second plurality of orifices from a second area proximate the filter section; and a packer disposed between the perforated section and the filter section, the packer operable to isolate the first area from the second area when the tubular string is disposed within the wellbore, wherein the perforated section and filter section are integral on the tubular joint.

10. The production system of claim 9, wherein the filter assembly comprises a sand screen.

11. The production system of claim 10, wherein the filter assembly further comprises a shroud surrounding the sand screen.

12. The production system of claim 9, further comprising an electric submersible pump ("ESP") coupled to the tubular string and positioned uphole of the tubular joint when the tubular string is disposed within the wellbore.

13. The production system of claim 12, wherein the ESP is coupled to the first end of the tubular joint.

14. The production system of claim 9, wherein the packer is a cup seal packer.

15. The production system of claim 9, further comprising a retention assembly coupled to the tubular joint to retain the packer on the tubular joint.

16. The production system of claim 15, wherein the retention assembly comprises at least one of a bracket or a retention ring.

17. The production system of claim 9, wherein the packer is a slip-on packer.

18. A method for producing formation fluids from a formation, the method comprising:

positioning a tubular string comprising a tubular joint within a wellbore extending through the formation;

filtering a fluid flowing from a first annulus surrounding a filter section of the tubular joint into the tubular joint via a filter assembly of the tubular joint;

isolating the first annulus surrounding a second annulus surrounding a perforated section of the tubular joint via a packer of the tubular joint; and flowing the filtered fluid entering the tubular joint into the second annulus via orifices in the filter section of the tubular joint, wherein the perforated section and the filter section are integral on the tubular joint.

19. The method of claim 18, further comprising pumping the filtered fluid within the second annulus uphole via an electric submersible pump ("ESP").

20. The method of claim 18, further comprising installing the packer of the tubular joint at a wellsite.

* * * * *